US010500456B1

(12) United States Patent
Cardone

(10) Patent No.: US 10,500,456 B1
(45) Date of Patent: Dec. 10, 2019

(54) GOLF BALL RETRIEVAL SYSTEM

(71) Applicant: Christopher Cardone, The Villages, FL (US)

(72) Inventor: Christopher Cardone, The Villages, FL (US)

( * ) Notice: Subject to any disclaimer, the term of this patent is extended or adjusted under 35 U.S.C. 154(b) by 0 days.

(21) Appl. No.: 16/395,513

(22) Filed: Apr. 26, 2019

(51) Int. Cl.
*A63B 57/00* (2015.01)
*A63B 47/02* (2006.01)
*A63B 57/30* (2015.01)
*A63B 57/40* (2015.01)

(52) U.S. Cl.
CPC ..... *A63B 57/357* (2015.10); *A63B 47/02* (2013.01); *A63B 57/40* (2015.10)

(58) Field of Classification Search
CPC ..... A63B 47/02; A63B 57/357; A63B 57/40; A63B 57/405
USPC ..... 294/19.2; 473/175–177
See application file for complete search history.

(56) References Cited

U.S. PATENT DOCUMENTS 979,313 A * 12/1910 King et al.
1,538,822 A * 5/1925 Kennedy ..... A63B 57/357 473/176
1,599,734 A * 9/1926 Wilson ..... A63B 57/357 473/177
1,829,283 A * 10/1931 Kip ..... A63B 57/357 473/177
2,684,245 A * 7/1954 Jacoby ..... A63B 57/357 473/176
3,180,644 A * 4/1965 Winquist ..... A63B 47/02 473/177
3,310,026 A * 3/1967 Baird, Jr. ..... A63B 57/357 116/173
3,790,166 A * 2/1974 Hamilton ..... A63B 57/40 473/177
5,120,063 A * 6/1992 Birchler ..... A63B 57/357 473/180
5,393,053 A * 2/1995 Wiese ..... A63B 57/405 473/177
6,428,068 B1 * 8/2002 Lavine ..... A63B 47/02 294/19.2
2008/0171609 A1 * 7/2008 Priegel ..... A63B 57/357 473/176
2009/0280919 A1 * 11/2009 Prince ..... A63B 69/3676 473/176

* cited by examiner

*Primary Examiner* — Dean J Kramer
(74) *Attorney, Agent, or Firm* — Mitchell J. Mehlman, Esq.

(57) ABSTRACT

A golf cup insert has a funnel shaped body including a wall. The wall defines a first aperture having a diameter D1 and a second aperture having a diameter D2. The diameter D1 is sized to fit within a regulation size golf hole; the diameter D2 is smaller than the diameter D1. The insert can be used in a golf ball retrieval system to lift a golf ball out of a golf hole to assist the user and to prevent damage to the hole; the system also eliminates the need for any outside ball retrieval device.

14 Claims, 8 Drawing Sheets

GOLF BALL RETRIEVAL SYSTEM

TECHNICAL FIELD

The present invention is directed to golf ball retrieval systems and devices for easily and safely removing one or more golf balls from a golf hole. The systems and devices function to remove one or more balls from a golf hole without causing damage to the edge of the hole and without causing damage to the green. Further, the user does not have to bend over in order to remove a golf ball from a golf hole.

BACKGROUND

In 2019, the United States Golf Association (USGA) implemented new rules. According to the USGA, under Rule 13.2a(2), "There will no longer be a penalty if a ball played from the putting green hits a flagstick left in the hole." Players will still have the option to remove the flagstick or to have someone tend the pin and remove it after the ball is struck. Thus, it is no longer required that golf players remove the flagstick from the hole when putting on the putting green. Under previous rules, the flagstick had to be removed or the player was assessed a penalty.

While removing the flagstick to help in retrieving a golf ball from the golf hole is still considered proper etiquette, it requires that the task be performed by hand. This requires that the user remove the stick and bend down to remove the ball manually.

Using the flagstick to pinch and pull up the ball from the hole is not considered proper etiquette. Many older people use various ball retrieval devices to avoid bending. Such devices include for example, a pole with a grabbing end to capture the ball.

When these ball retrieval devices are used while the flagstick is still in place, the device can cause damage to the delicate edge of the hole or cup, and can degrade the putting surface for players following the player retrieving a ball in such a manner.

Many courses have implemented rules that require the flagstick be removed before using a ball retrieving device, however, many people do not follow the rules, thus causing significant damage to the holes on a golf course and degradation of the quality of play for all players.

Based on the foregoing, there is a need to provide systems and devices that can be used to easily remove one or more golf balls from a golf hole, where the user is not required to bend, and without causing damage to the edges of the hole or to the putting green.

SUMMARY

There is disclosed herein a golf cup insert. In one aspect of the present invention, the insert has a funnel shaped body including a wall. The wall defines a first aperture having a diameter D1 and a second aperture having a diameter D2. The diameter D1 is sized to fit within a regulation size golf hole.

In some embodiments, the ratio of the diameter D2 to the diameter D1 is in the range of between about 15% and about 35%.

In certain embodiments, at least a portion of the wall defines an angle Θ formed between the wall and an axis A.

In particular embodiments, the angle Θ is between about 35 degrees and about 55 degrees.

In some embodiments, the wall includes a plurality of slotted apertures.

In some other embodiments, the wall includes a first plurality of slotted apertures having a length L1 and a second plurality of slotted apertures having a length L2.

In some particular embodiments, the length L1 is greater than the length L2.

In certain embodiments, the length L2 is between about 40% and about 60% of the length L1.

In yet other embodiments, the first plurality of apertures and the second plurality of apertures are arranged in an alternating star shaped pattern radiating from the diameter D2.

In another aspect, a golf ball retrieval system includes a funnel shaped body. The funnel shaped body has a wall defining a first aperture having a diameter D1 and a second aperture having a diameter D2. The diameter D1 is sized to fit within a regulation size golf hole. A flagstick includes a first cylindrical portion. The first cylindrical portion includes a first end having a flag attached thereto, and a second end having retaining portion for engaging a golf hole. The retaining portion removably secures the flagstick in a golf hole. The retaining portion including a second cylindrical portion and a flange. The funnel shaped body is adapted to removably engage the flange.

In some embodiments of this aspect, the ratio of the diameter D2 to the diameter D1 is in the range of between about 15% and about 35%.

In certain embodiments, at least a portion of the wall defines an angle Θ formed between the wall and an axis A.

In particular embodiments, the angle Θ is between about 35 degrees and about 55 degrees.

In some embodiment, the wall includes a plurality of slotted apertures.

In other embodiments, the wall includes a first plurality of slotted apertures having a length L1 and a second plurality of slotted apertures having a length L2.

In particular embodiments, the length L1 is greater than the length L2.

In some embodiments, the length L2 is between about 40% and about 60% of the length L1.

In other embodiments, the first plurality of apertures and the second plurality of apertures are arranged in an alternating star shaped pattern radiating from the diameter D2.

In another aspect of the instant invention, a method of retrieving a golf ball from a golf hole includes the steps of: connecting an insert to a flagstick, the insert includes a funnel shaped body having a wall defining a first aperture having a diameter D1 and a second aperture having a diameter D2, wherein the diameter D1 is sized to fit within a regulation size golf hole, the flagstick includes a first cylindrical portion including a first end having a flag attached thereto, and a second end having retaining portion for engaging a golf hole to removably secure the flagstick therein, the retaining portion includes a second cylindrical portion and a flange, the funnel shaped body is adapted to removably engage the flange; engaging the second cylindrical portion within a retaining aperture in the golf hole thereby securing the flagstick in a vertical position; putting a golf ball into the golf hole, whereby the golf ball is captured by the funnel shaped body; lifting the flagstick to disengage the retaining portion from the golf hole thereby causing the insert to rotate and retain the golf ball; and retrieving the golf ball.

In some embodiments of this aspect, the ratio of the diameter D1 to the diameter D2 is in the range of between about 15% and about 35%.

DETAILED DESCRIPTION

Figure 1:
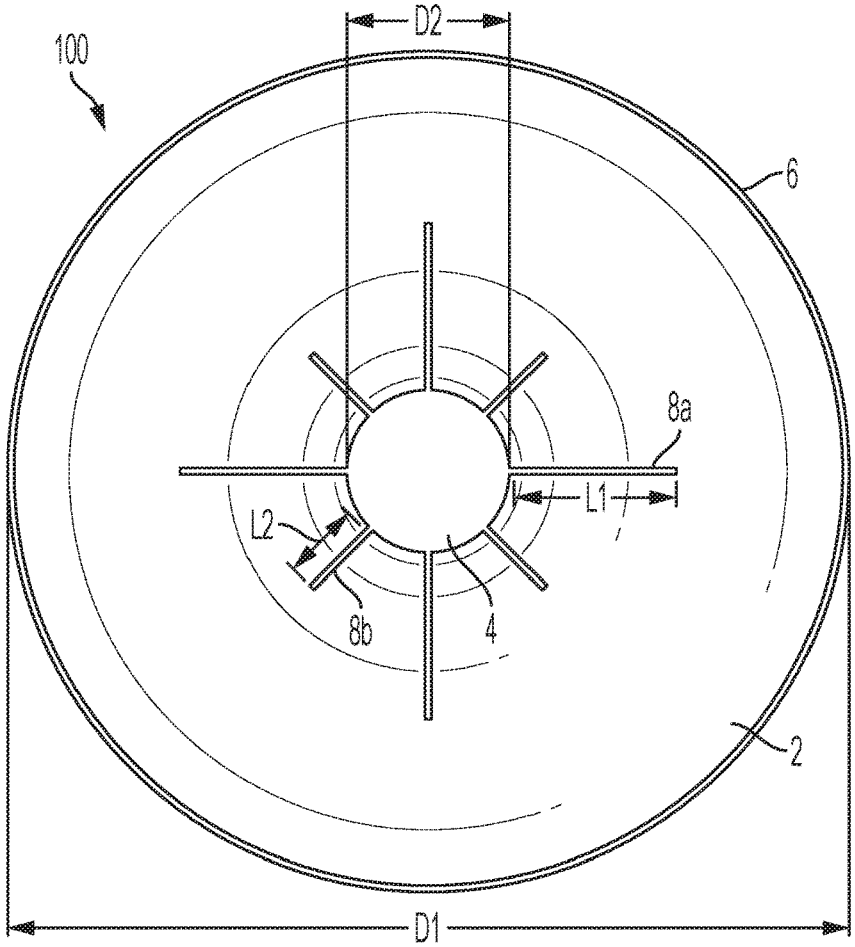
FIG. 1 is a plan view of an element of a golf ball retrieval system.
Figure 2:
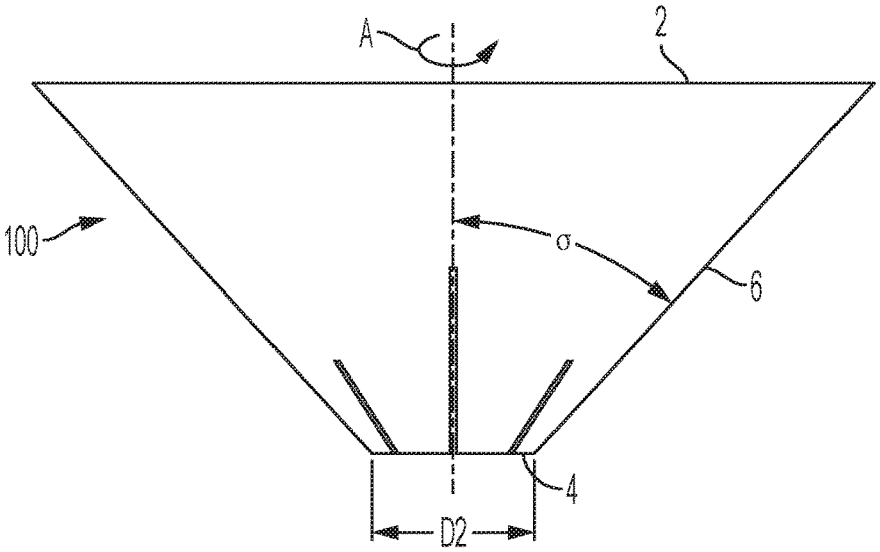
FIG. 2 is a side view of the element shown in FIG. 1.
Figure 3:
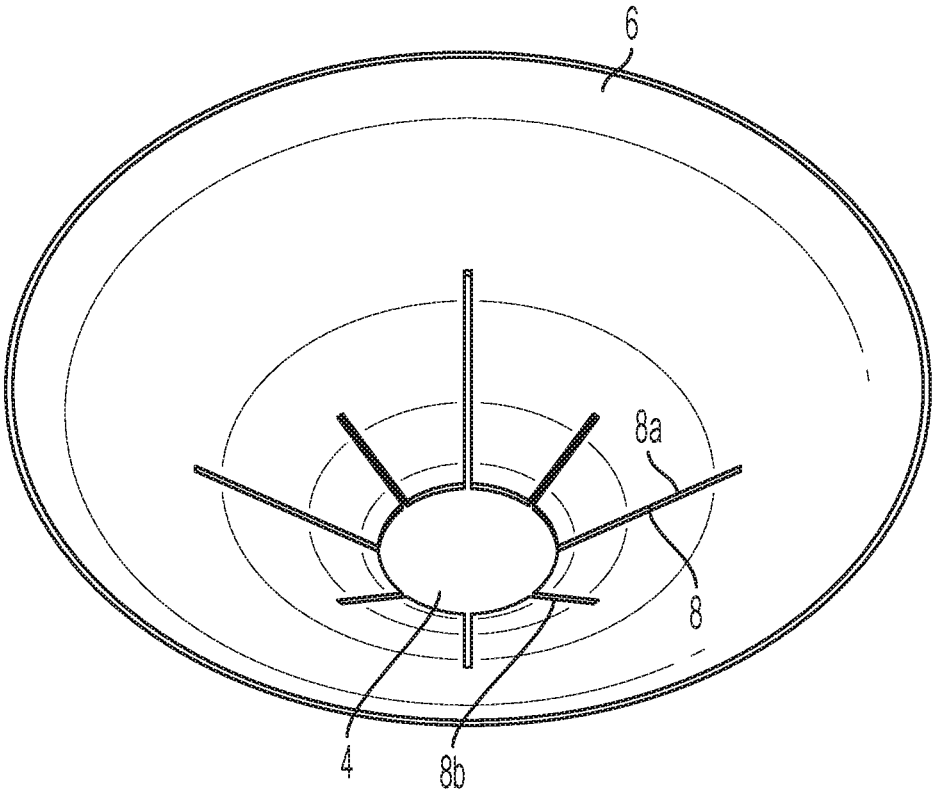
FIG. 3 is an isometric view of the element shown in FIG. 1.

As shown in FIG. 1-3, a golf cup insert 100 is designed to fit in a golf hole 20. A golf hole 20 is by regulation 4.25 inches in diameter and at least 4 inches deep. The insert 100 has a tapered funnel shape including a first aperture 2, having a diameter D1, a second aperture 4 having a diameter D2 and a wall 6 extending between the first aperture 2 and the second aperture 4 at an angle Θ relative a longitudinal axis A. The angle Θ is between about 20 degrees and about 65 degrees, preferably in the range of between about 35 degrees and about 55 degrees. In some embodiments, at least a portion of the wall 6 extends at the angle Θ relative a longitudinal axis A. The ratio of the diameter D2 to D1 can be in the range of between about 10% and about 60%, more preferably in the range of between about 15% and about 35%. It is also contemplated that in some embodiments a first portion of the wall 6 extends at the angle Θ relative to the longitudinal axis A and a second portion of the wall 6 extends at a different angle Θ' relative a longitudinal axis A.

Figure 9:
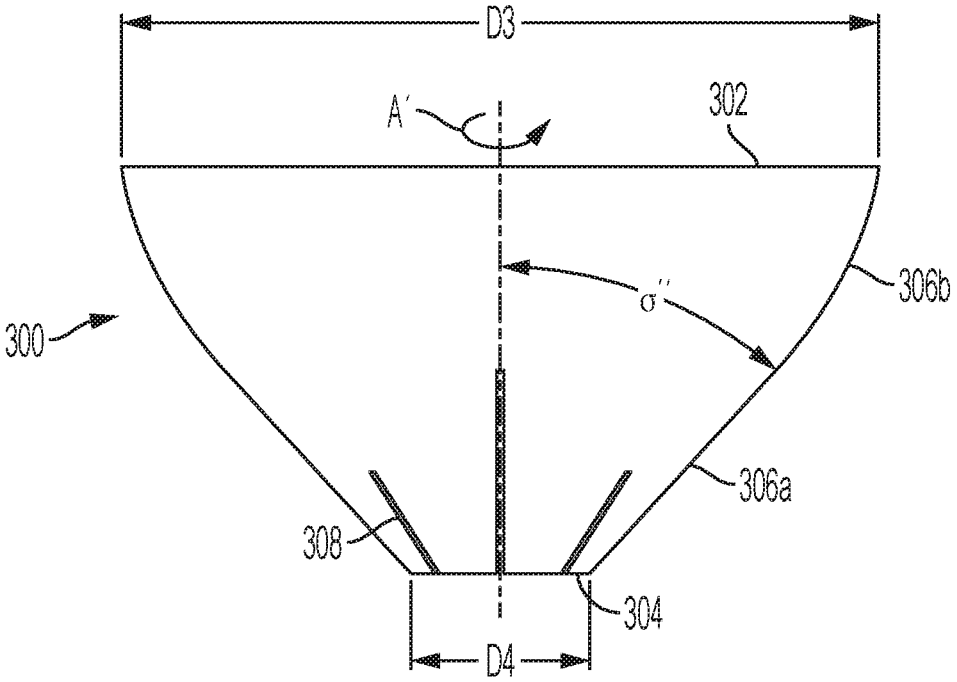
FIG. 9 is alternate embodiment of one of the elements of the golf ball retrieval system.

As shown in FIG. 9, the insert 300 can be configured to include a first aperture 302, having a diameter D3, a second aperture 304 having a diameter D4 and a wall 306 extending between the first aperture 302 and the second aperture 304. The wall 306 can be configured to include a first portion 306*a* extending at the angle Θ" relative to the longitudinal axis A' and a second curved portion 306*b*. The insert can include a plurality of radial slots 308. The angle Θ" is between about 20 degrees and about 65 degrees, preferably in the range of between about 35 degrees and about 55 degrees. The ratio of the diameter D4 to D3 can be in the range of between about 10% and about 60%, more preferably in the range of between about 15% and about 35%. It is also contemplated that in some embodiments a first portion of the wall 306 extends at the angle Θ" relative to the longitudinal axis A' and at least a second portion of the wall 306 extends at a different angle relative a longitudinal axis A'.

The insert 100, 300 is designed to fit in a regulation golf hole such that it is easily installed and removed and it does not interfere with or in any way impede the path of the golf ball. The insert 100, 300 is designed such that the shape allows for easy capture of one or more golf balls when the insert is installed in a golf hole, while the insert 100, 300 is able to retain one or more golf balls when the insert is lifted and removed from the golf hole as discussed herein. In some alternate embodiments, the insert 100, 300 is designed allow a ball to be released onto the green upon lifting of the flagstick rather than being retained.

In this embodiment, the insert 100 includes a plurality of slots 8 extending outwardly from the second aperture 4. As shown in FIG. 1-3, the plurality of slots includes a symmetrical star shaped pattern radiating from the second aperture 4. The plurality of slots can include four slots 8*a* having a length L1 and four slots having a length L2. The length L2 of the slots 8*b* is less than or equal to the length L1 of the slots 8*a*. In some embodiments, the length of L2 is between about 40% and about 60% of the length of L1. It should be considered that in some embodiments the insert can be made in one or more pieces, for example, in a two-piece snap together arrangement. The plurality of slots may not be necessary in some embodiments, as long as the insert is flexible enough to be fitted on the flagstick and sturdy enough to remain in place during play.

The insert 100 is preferably made from a polymeric material such as a thermoplastic. The insert 100 can be molded for example, by injection or compression molding. Other materials such as metallic materials, ceramics or elastomers can also be utilized.

Referring to FIGS. 4-8, a golf ball retrieval system 200 including the golf cup insert 100 (or 300 hereinafter) is shown. The system includes a flagstick 10. The flagstick 10 includes a first cylindrical portion 12 having a first end 14 for securing a flag 16 and a second end 18 for engaging a golf cup or hole 20.

The flagstick 10, includes a retaining portion 22 proximate to the second end 18. The retaining portion 22, includes a first end 24 having a flange 26 and a second end 28 having a second cylindrical portion 30 sized to fit an aperture (not shown) in a golf cup or hole 20 to retain the flagstick 10 and allow for easy removal and replacement of the flagstick during play. The flange 26 has a diameter D5. The diameter D2 of the second aperture 4 is slightly larger than the diameter D5 thereby allowing the insert, which is flexible in the area of the plurality of slots 8 to be easily fit onto or be removed from the flagstick 10. In the installed position (e.g. FIGS. 4-5) the insert 100 rests on the flange 26, thereby forming a funnel shaped cup which can retain one or more golf balls 28.

Figure 4:
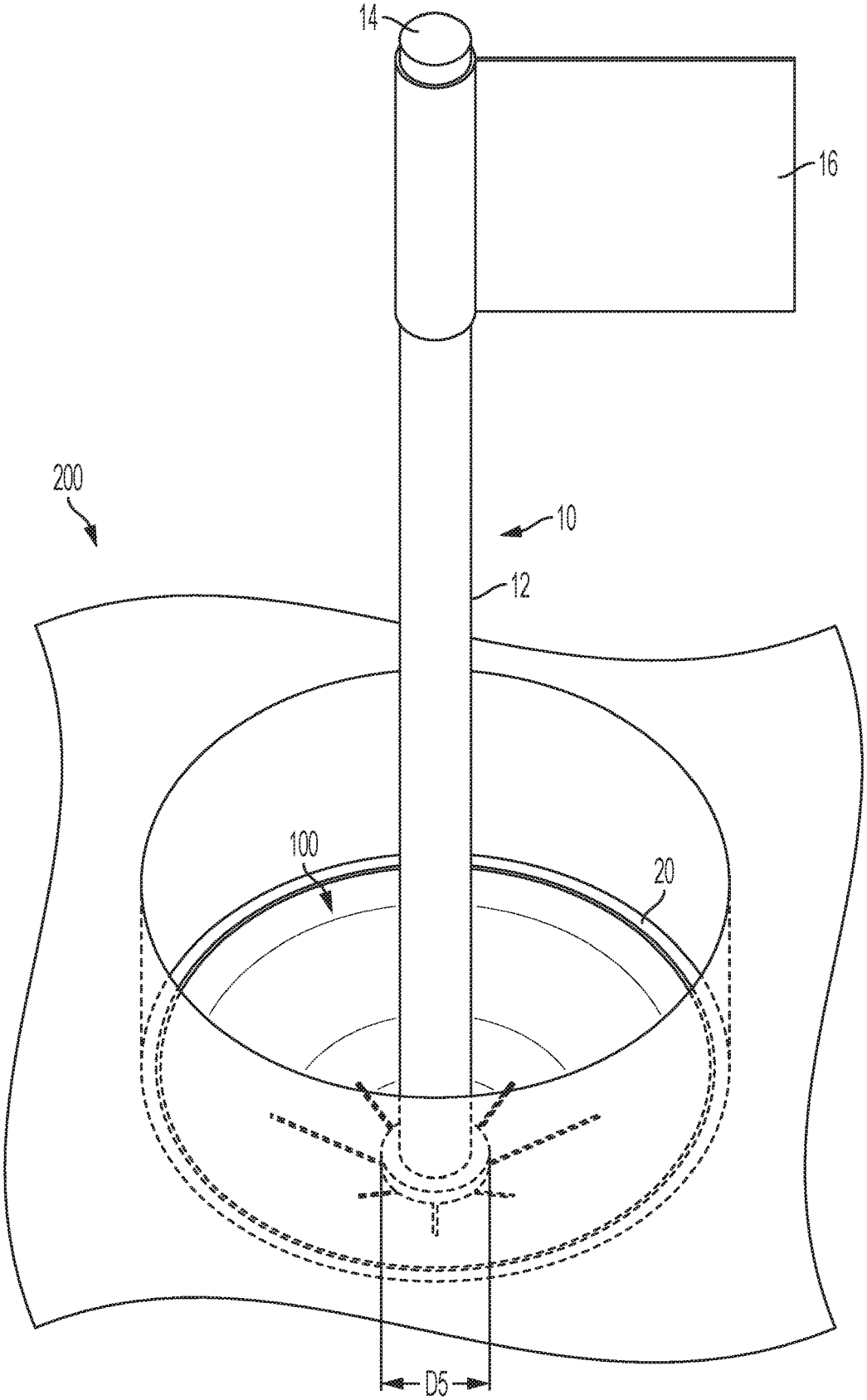
FIG. 4 is an isometric view of some of the elements of the golf ball retrieval system.
Figure 5:
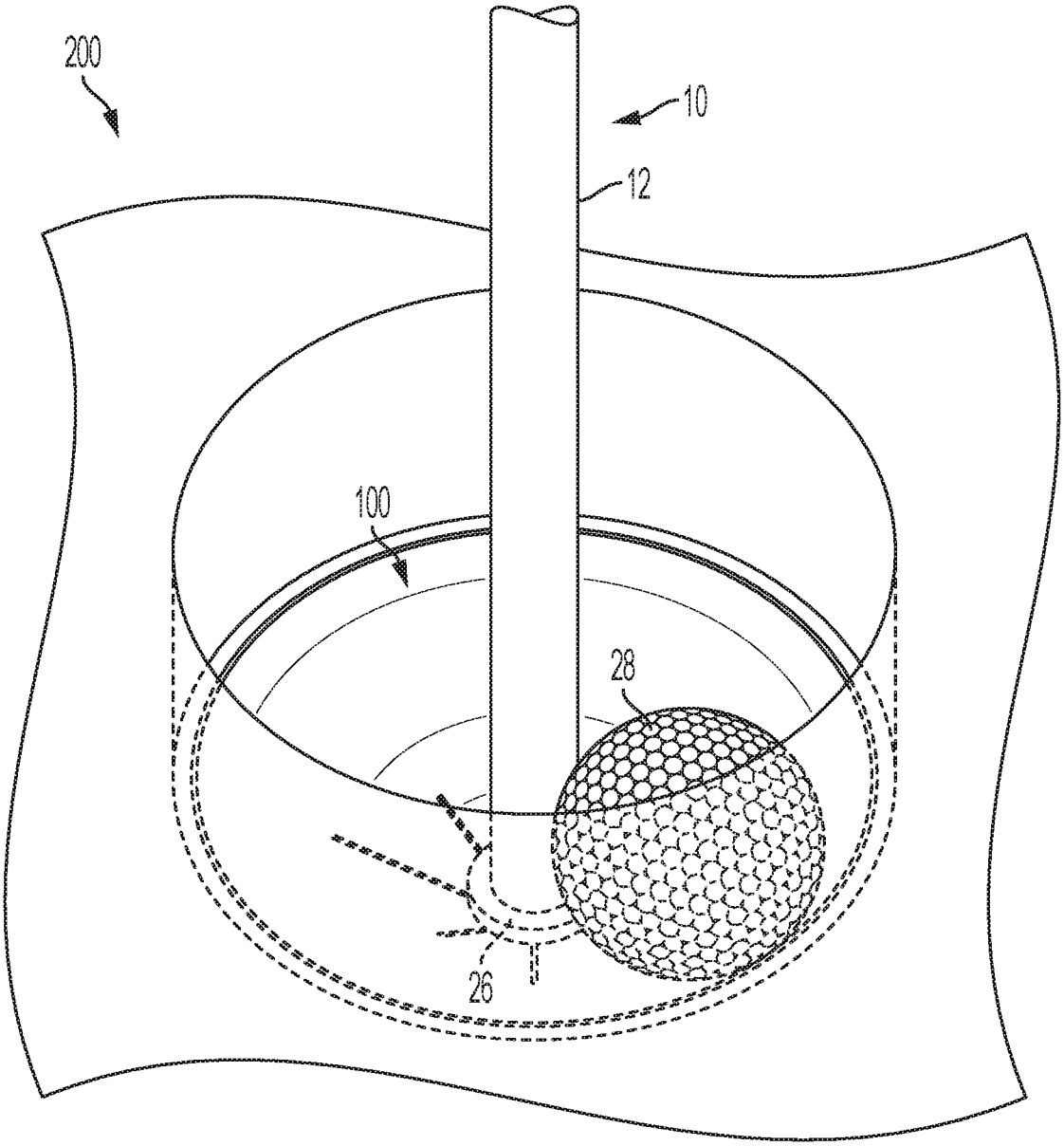
FIG. 5 is an isometric view of some of the elements of the golf ball retrieval system include a golf ball.
Figure 6:
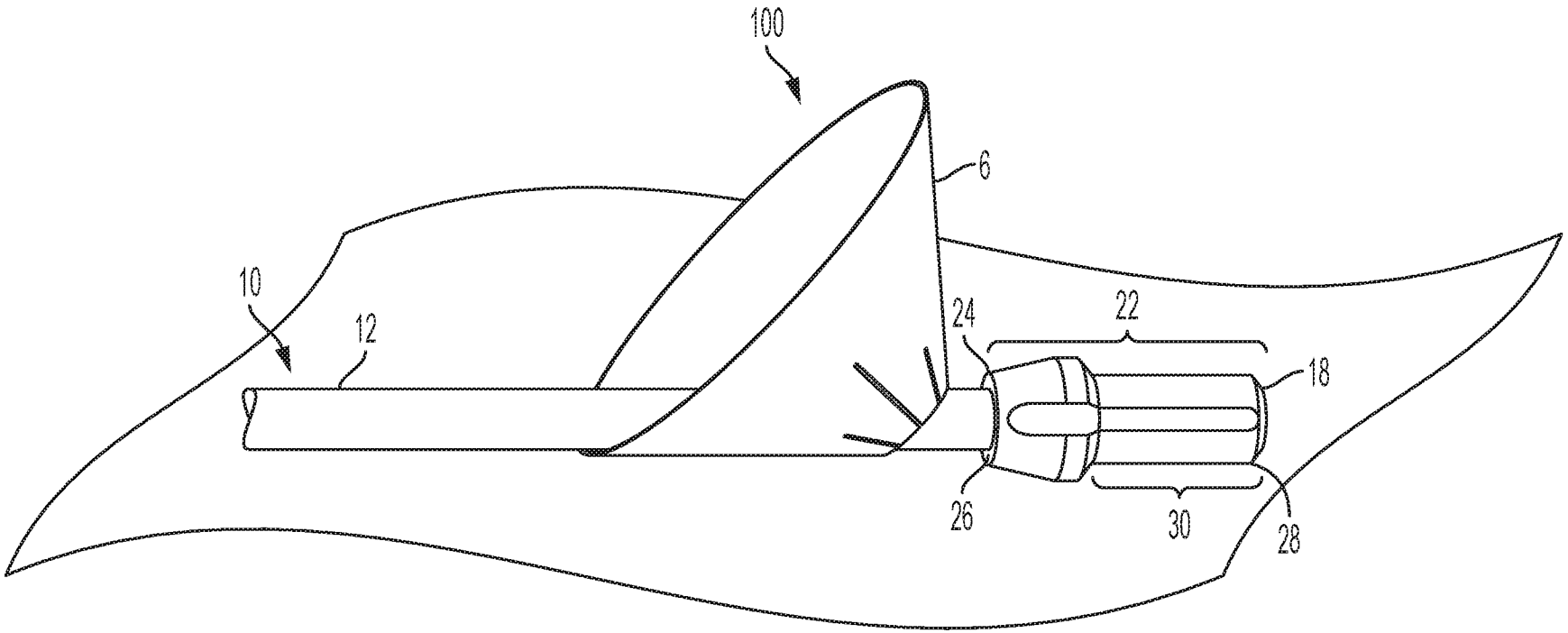
FIG. 6 is a side view of some of the elements of the golf ball retrieval system depicting the system in a prone position.

As shown in FIG. 6, the system 200 can be placed in a prone position, for example, while putting, the flagstick 10 is often placed on the sensitive green. Advantageously, when the system 200 is prone, the insert 100 is free to float from the installed (in a hole) position (as shown in FIGS. 4-5) to the uninstalled prone position. The shape and elements of the insert 100 allow the insert 100 to move so that the wall 6 is essentially parallel to the ground or green thereby avoiding damage to the area where the system is temporarily placed during play.

Figure 7:
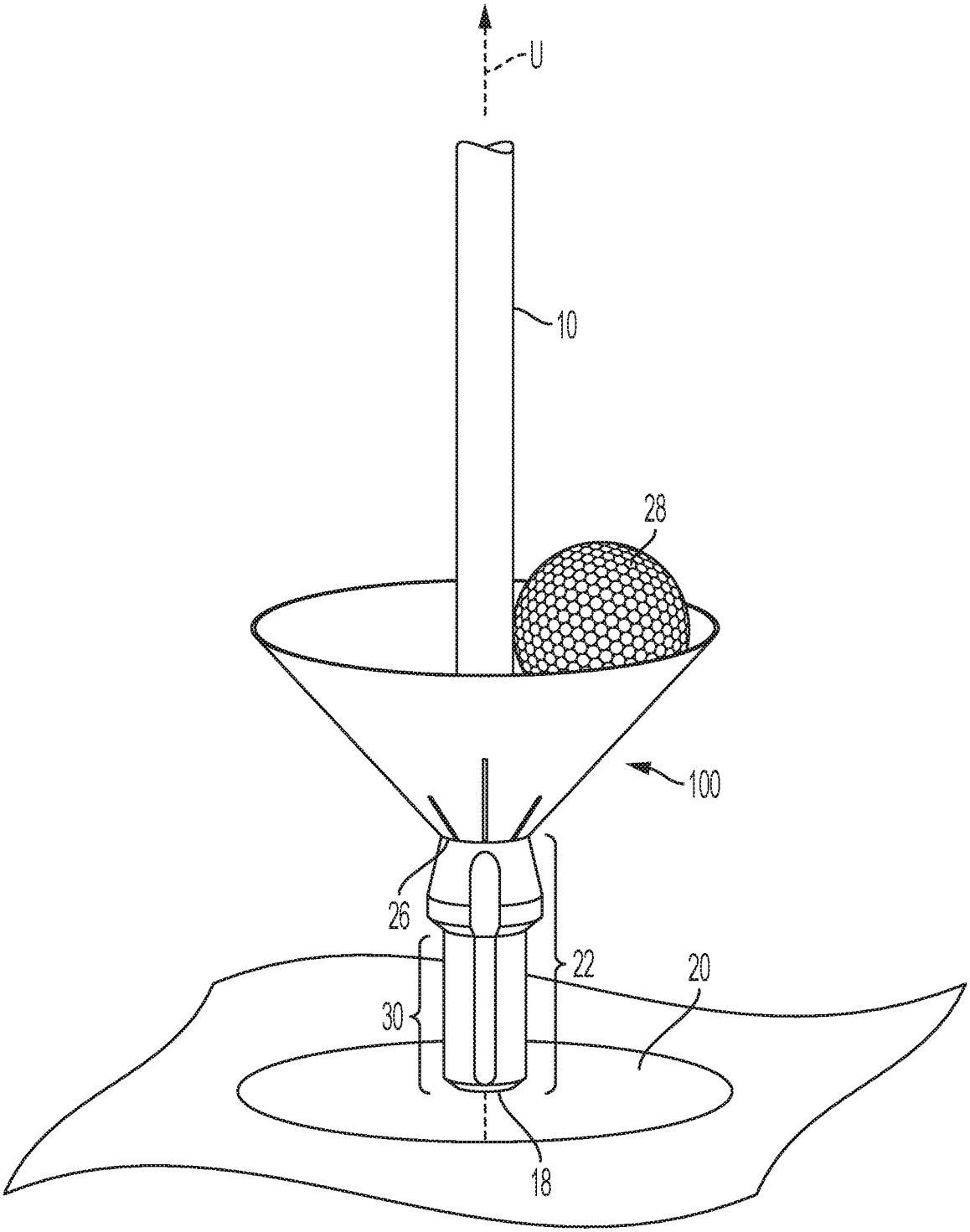
FIG. 7 is an isometric view of the golf ball retrieval system depicting removal from a golf hole.
Figure 8:
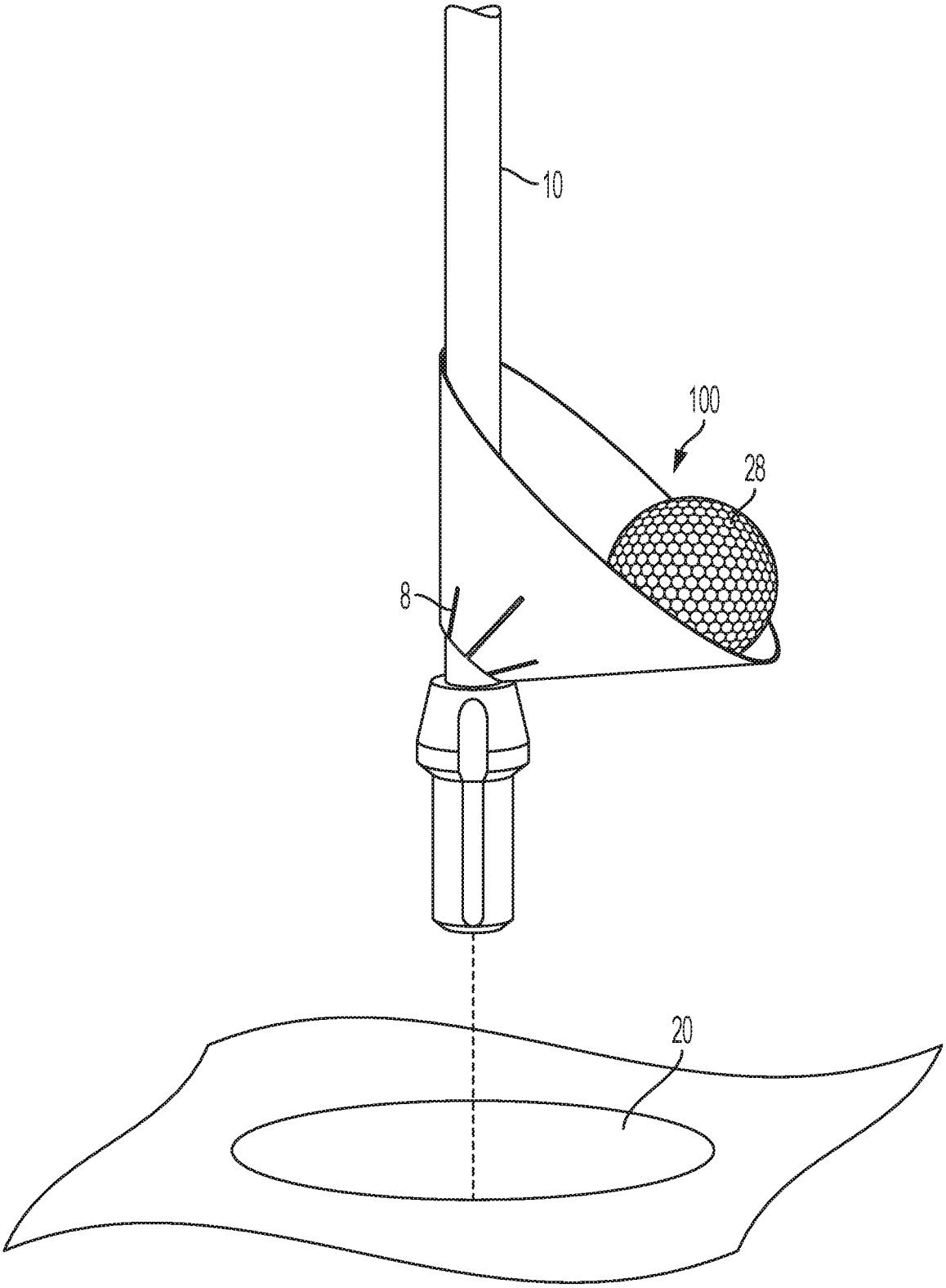
FIG. 8 is an isometric view of the golf ball retrieval system depicting removal from a golf hole.

Referring to FIGS. 7-8, the system 200 is shown as being removed from a golf hole 20. The flagstick 10 is typically pulled upward in the direction of arrow U, so that the retaining portion 30 disengages from an aperture (not shown) at the bottom of the hole 20. Initially, the golf ball 28 is retained in the insert 100. Because the shape of the insert, the weight of the golf ball 28 causes the insert 100 to tilt slightly, thereby retaining the golf ball 28. The golf ball 28 may now be recovered by hand thereby eliminating potential damage to the edge of the cup or hole that may have been caused by traditional manual retrieval.

LIST OF ELEMENTS

2 first aperture
4 second aperture
6 wall

8 slots
8*a* slots with length L1
8*b* slots with length L2
10 flagstick
12 first cylindrical portion
14 first end
16 flag
18 second end
20 golf hole or cup
22 retaining portion
24 first end
26 flange
28 second end
30 second cylindrical portion
100 golf cup insert
200 golf ball retrieval system
300 insert
302 first aperture
304 second aperture
306 wall
306*a* angled portion
306*b* curved portion
308 slots
D1/D3 diameter first aperture
D2/D4 diameter second aperture
D5 diameter flange
Θ/Θ" angle
A/A' axis
U upward arrow Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A golf cup insert comprising:

a funnel shaped body including a wall defining a first aperture having a diameter D1 and a second aperture having a diameter D2, wherein the diameter D1 is sized to fit within a regulation size golf hole and the wall includes a first plurality of slotted apertures having a length L1 and a second plurality of slotted apertures having a length L2, the length L1 being greater than the length L2.

2. The golf cup insert of claim 1, wherein the ratio of the diameter D2 to the diameter D1 is in the range of between about 15% and about 35%.

3. The golf cup insert of claim 1, wherein at least a portion of the wall defines an angle Θ formed between the wall and an axis A.

4. The golf cup insert of claim 3, wherein the angle Θ is between about 35 degrees and about 55 degrees.

5. The golf cup insert of claim 1, wherein the length L2 is between about 40% and about 60% of the length L1.

6. The golf cup insert of claim 1, wherein the first plurality of slotted apertures and the second plurality of slotted apertures are arranged in an alternating star shaped pattern radiating from the diameter D2.

7. A golf ball retrieval system comprising:

a funnel shaped body including a wall defining a first aperture having a diameter D1 and a second aperture having a diameter D2, wherein the diameter D1 is sized to fit within a regulation size golf hole, and the wall includes a first plurality of slotted apertures having a length L1 and a second plurality of slotted apertures having a length L2, the length L1 being greater than the length L2; and a flagstick including a first cylindrical portion including a first end having a flag attached thereto, and a second end having retaining portion for engaging a golf hole to removably secure the flagstick therein, the retaining portion including a second cylindrical portion and a flange, the funnel shaped body being adapted to removably engage the flange.

8. The golf ball retrieval system of claim 7, wherein the ratio of the diameter D2 to the diameter D1 is in the range of between about 15% and about 35%.

9. The golf ball retrieval system of claim 7, wherein at least a portion of the wall defines an angle Θ formed between the wall and an axis A.

10. The golf ball retrieval system of claim 9, wherein the angle Θ is between about 35 degrees and about 55 degrees.

11. The golf ball retrieval system of claim 7, wherein the length L2 is between about 40% and about 60% of the length L1.

12. The golf ball retrieval system of claim 7, wherein the first plurality of slotted apertures and the second plurality of slotted apertures are arranged in an alternating star shaped pattern radiating from the diameter D2.

13. A method of retrieving a golf ball from a golf hole comprising;

connecting an insert to a flagstick, the insert including a funnel shaped body including a wall defining a first aperture having a diameter D1 and a second aperture having a diameter D2, wherein the diameter D1 is sized to fit within a regulation size golf hole, and the wall includes a first plurality of slotted apertures having a length L1 and a second plurality of slotted apertures having a length L2, the length L1 being greater than the length L2, the flagstick including a first cylindrical portion including a first end having a flag attached thereto, and a second end having retaining portion for engaging a golf hole to removably secure the flagstick therein, the retaining portion including a second cylindrical portion and a flange, the funnel shaped body being adapted to removably engage the flange;

engaging the second cylindrical portion within a retaining aperture in the golf hole thereby securing the flagstick in a vertical position;

putting a golf ball into the golf hole, whereby the golf ball is captured by the funnel shaped body;

lifting the flagstick to disengage the retaining portion from the golf hole thereby causing the insert to rotate and retain the golf ball therein; and retrieving the golf ball.

14. The method of claim 13, wherein the ratio of the diameter D2 to the diameter D1 is in the range of between about 15% and about 35%.

* * * * *